US007228848B1

(12) United States Patent
Rangel et al.

(10) Patent No.: US 7,228,848 B1
(45) Date of Patent: Jun. 12, 2007

(54) SELF POSITIONING FILTER ASSEMBLY

(75) Inventors: Gabriel Davila Rangel, Chihuahua (MX); Scott M. Atwell, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/348,808

(22) Filed: Feb. 7, 2006

(51) Int. Cl.
*F02M 37/04* (2006.01)
*F02M 11/03* (2006.01)

(52) U.S. Cl. ..... 123/509; 123/196 A

(58) Field of Classification Search ..... 123/509, 123/495, 497, 510, 196 A; 210/191, 258, 210/232, 416.1, 416.4
See application file for complete search history.

(56) References Cited

U.S. PATENT DOCUMENTS 5,795,468 A * 8/1998 Reising et al. ..... 210/172
6,361,691 B1 3/2002 Dockery et al.
6,471,072 B1 * 10/2002 Rickle et al. ..... 210/486
6,638,423 B2 10/2003 Dockery
6,739,319 B2 * 5/2004 Braun et al. ..... 123/509
6,743,355 B2 6/2004 Roth et al.
6,821,422 B1 * 11/2004 Brzozowski et al. ..... 210/416.4
6,830,687 B2 12/2004 Dockery et al.
6,833,070 B2 12/2004 Fischer et al.
6,907,865 B1 * 6/2005 Hanby ..... 123/509
6,936,168 B2 8/2005 Dockery et al.
6,951,208 B2 * 10/2005 Milton ..... 123/509
6,966,305 B2 * 11/2005 Aubree et al. ..... 123/509
2004/0251194 A1 * 12/2004 Brzozowski et al. ..... 210/416.4

* cited by examiner

*Primary Examiner*—Mahmoud Gimie
(74) *Attorney, Agent, or Firm*—Paul L. Marshall

(57) ABSTRACT

A filter assembly having a filter element that is self positioning into a preferential filtering position upon insertion into a tank which will contain the medium to be filtered (e.g., gasoline, oil, etc.).

21 Claims, 4 Drawing Sheets

SELF POSITIONING FILTER ASSEMBLY

TECHNICAL FIELD

The present invention relates to filter systems and, more particularly, relates to a filter assembly having a self positioning filter element.

BACKGROUND OF THE INVENTION

Filters and filter assemblies are commonly used in applications where a liquid needs to be cleaned of particulate matter larger than a certain predetermined size. For example, in gasoline powered engines, a filter assembly may be used to remove particulate in the fuel that would otherwise clog and adversely affect the efficiency of the engine. The fuel filter assembly may have a first stage filter that removes larger particulate from the fuel and a second stage filter that removes smaller particulate from the fuel prior to the fuel being delivered to the engine. A typical vehicle fuel delivery system includes a fuel tank, a fuel pump, a fuel filter assembly and fuel lines through which the filtered fuel is pumped to the vehicle engine. The first stage fuel filter may be attached to an inlet of the fuel pump so that the fuel passes through the first stage filter immediately prior to entering the fuel pump. The filtered fuel is then pumped from the fuel pump to the second stage fuel filter which removes finer particulate from the fuel. The fuel then travels through a fuel line leading to the engine. A fuel regulator is also usually provided to control fuel pressure in the fuel line.

A mounting platform may be used upon which the fuel pump and fuel filters are mounted, the combination of which is typically referred to as a "fuel module". The mounting platform and components thereon are then inserted through an opening in the fuel tank to position the components within the fuel tank. The mounting platform is firmly secured to the tank and seals the opening closed. Should the fuel delivery components within the fuel tank need servicing, the mounting platform is simply detached from the tank and removed along with the fuel delivery components mounted thereto.

The dimensions of the fuel tank and the fuel delivery components described above varies according to the requirements of the vehicle design. A fuel delivery system for a motorcycle is therefore very different than a fuel delivery system for an automobile. A motorcycle requires much smaller fuel delivery system components and this is a critical design consideration of a motorcycle fuel delivery system designer. Thus, the various fuel system components must be designed with the specific space requirements of the vehicle application in mind. Other equally important design considerations include ease of assembly and positioning of the components for optimum effectiveness. For example, the fuel filter is a porous material whose effectiveness is directly correlated to its surface area and placement within the fuel tank. The larger the surface area, the more fuel is strained therethrough. Likewise, the more of the filter that is submerged in the fuel (whose level continuously changes between full and near empty), the more of the filter is utilized in straining the fuel and its effectiveness is thus optimized. While fuel filters have been designed with the forgoing in mind, there remains a need for a fuel filter, particularly for small fuel tank applications, whose assembly is relatively simple and includes features which automatically position the filter in the tank for optimum effectiveness.

SUMMARY OF THE INVENTION

In a first aspect of the present invention, a filter assembly is provided having a filter element that is self positioning into a preferential filtering position upon insertion into a tank which will contain the medium to be filtered (e.g., gasoline, oil, etc.). In an embodiment of the invention, the filter element is mounted on a mounting platform for inserting through an opening in a fuel tank. The filter element includes a bearing surface which bears against a part of the fuel tank as the filter element is positioned within the tank. Thus, the act of inserting the filter element in the tank causes the bearing surface to press against a portion of the tank. As the filter element is passed further into the tank, the bearing surface moves relative to the mounting platform. The filter element moves with the bearing surface such that the filter element moves into a preferential position once the filter element is fully inserted into the tank. In one preferred embodiment, the filter element is attached to a fuel pump.

In an alternate embodiment of the invention, a filter assembly having first and second stage filter elements is provided wherein the first stage filter is self positioning upon insertion into a tank or other container which will contain the medium to be filtered (e.g., gasoline, oil, etc.). The first and second stage filter elements may be mounted on a mounting platform for inserting through an opening in a fuel tank. The first stage filter element includes a bearing surface which bears against a portion of the fuel tank as the filter elements are passed through the opening. Thus, the act of positioning the filter elements in the tank causes the bearing surface to press against the portion of the tank resulting in movement of the bearing surface relative to the mounting platform. The first stage filter element moves with the bearing surface such that the first stage filter element moves into a preferential filtering position once fully inserted into the tank.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
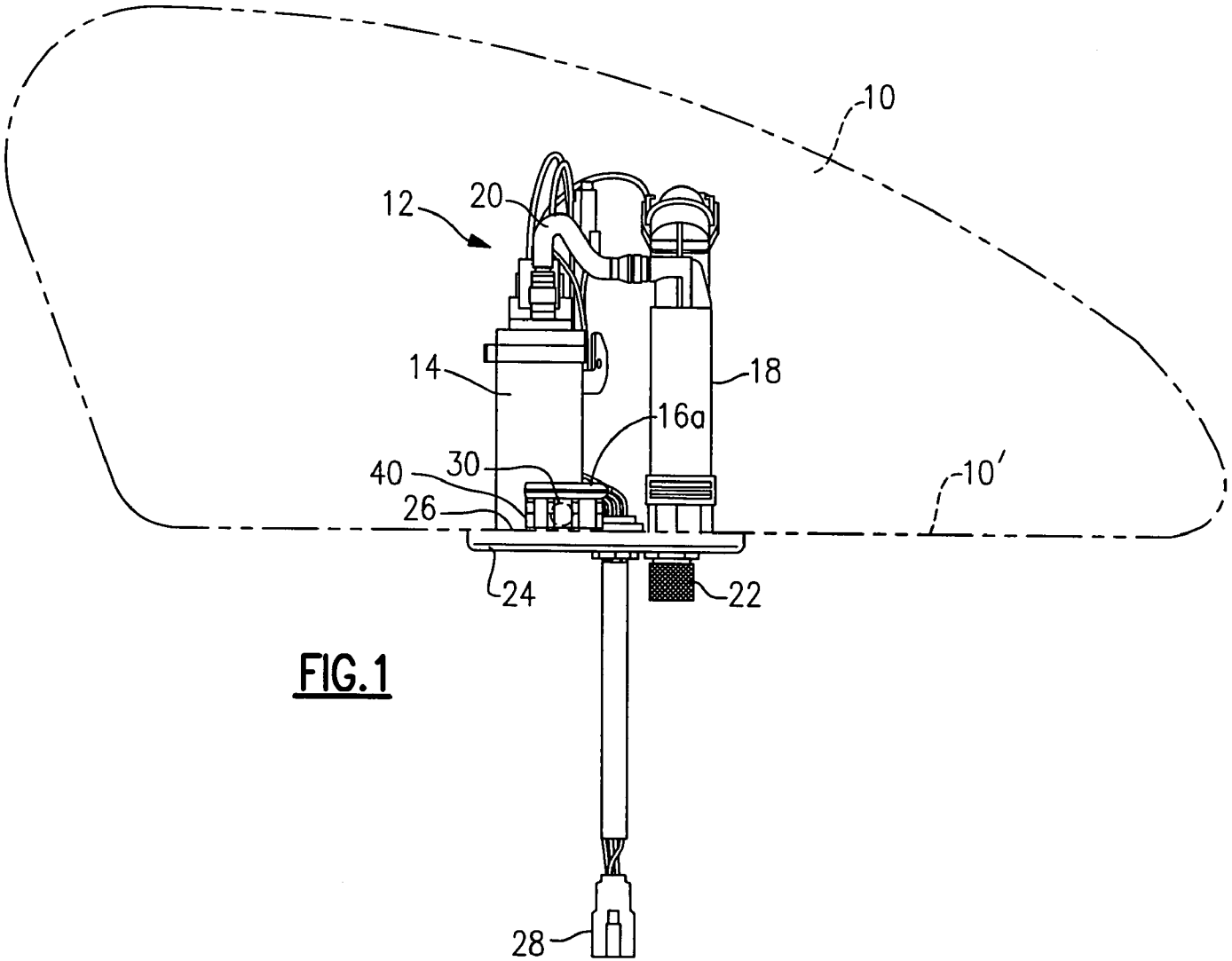
FIG. 1 is a side elevational view of a fuel tank and fuel delivery system mounted inside the tank.

Referring now to the drawing figures, there is seen in FIG. 1 a fuel tank 10 having a fuel delivery system 12 mounted inside tank 10. It is noted that fuel tank 10, which is used on a motorcycle, is for the purpose of providing an environment in which the present invention may be readily described. The invention is therefore not limited to the particular embodiments shown and described herein, but rather is applicable to any vehicle or other machine which requires filtering of any type of liquid medium (e.g., fuel, oil, etc.) which would benefit from the advantages the present invention offers.

Referring still to FIG. 1, fuel delivery system 12 is located within tank 10 as explained above. When the tank is filled with fuel, fuel system 12 is submersed in the fuel in the intended manner. Fuel system 12 basically includes a fuel pump 14, a first stage fuel filter 16 attached to pump 14, and a second stage fuel filter 18. A fuel line 20 extends between pump 14 and filter 18 whereby pump 14 operates to pump fuel to fuel filter 18. Fuel filter 18 connects to a fuel outlet 22 which attaches to an external fuel line that delivers fuel to the engine (not shown). The fuel delivery system components just described may be mounted upon a mounting platform 24 which allows the components to be inserted all at once through an opening 26 formed in the fuel tank bottom wall 10'. The mounting platform 24 thus functions as a component platform and is configured to close and create a leak-proof seal with opening 26 upon full insertion of the components of the fuel delivery system 12 into the fuel tank 10. An electrical connector 28 is provided through mounting platform 24 to connect to an electrical power source (e.g., the vehicle battery) to operate the fuel pump in a known manner.

Referring now to FIGS. 2A–3B, the inventive fuel filter element 16 and method of inserting the filter element into the fuel tank will now be described. Filter element 16 may be the only filter provided or may be a first stage filter designed to capture larger particulate from the fuel prior to the fuel entering fuel pump 14 and being passed on to a second stage filter element. Fuel filter element 16 includes an elongated filtering section 16*a* that is of generally rectangular configuration in the drawing but may be of any desired shape. The fuel filter element 16 is positioned over an inlet 30 that leads to the fuel pump 14. In the embodiment shown in the drawing, the inlet 30 is part of a connector 31 also having an outlet 32 arranged at a 90° angle to inlet 30. The outlet 32 is connected to the inlet (not shown) of the fuel pump 14 and thereby interconnects the filter element 16 to the pump 14. Fuel pump 14 includes a longitudinal axis X—X and the pump is mounted to the mounting platform 24 in an upright, vertically standing position as seen in the drawing although the orientation of the fuel pump and other components may vary depending on the application.

Figure 2C:
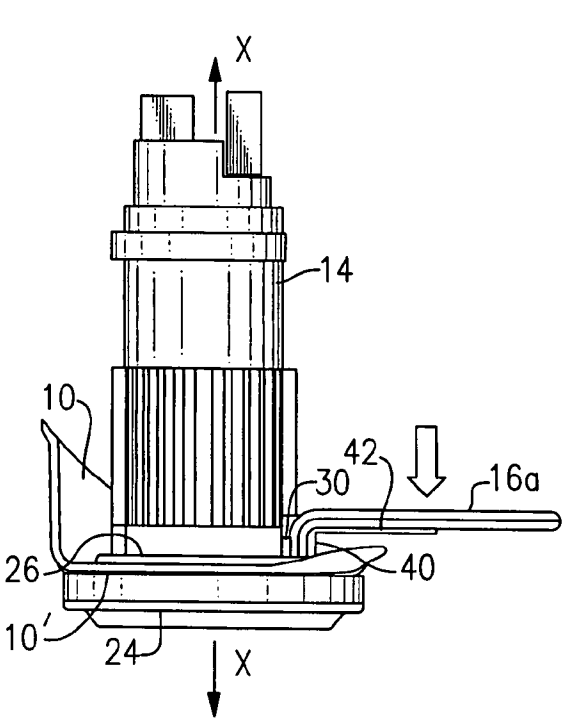
FIG. 2C is the view of FIG. 2B showing the pump and filter in a subsequent, final stage of attachment to the fuel tank.
Figure 2B:
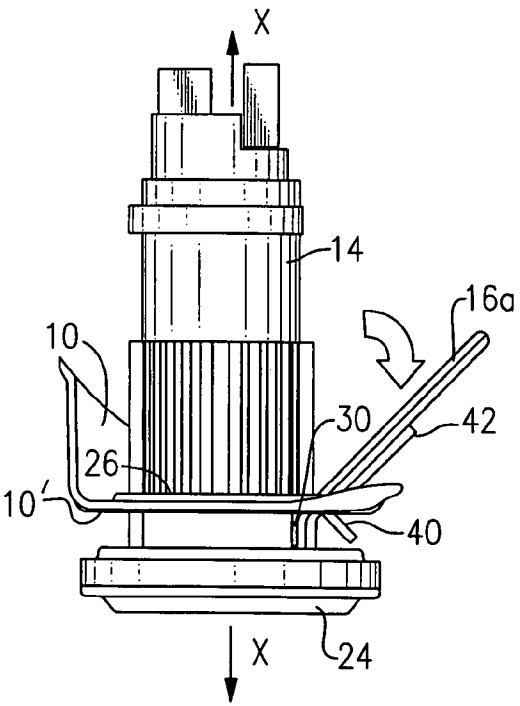
FIG. 2B is the view of FIG. 2A showing the pump and filter in a subsequent stage of attachment to the fuel tank.
Figure 2A:
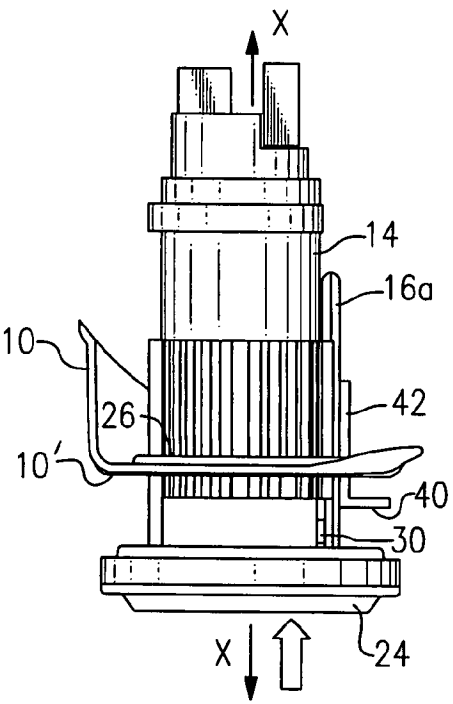
FIG. 2A is a side elevational view of a fuel pump and fuel filter according to a first embodiment of the invention and showing the pump and filter in a first stage of attachment to the fuel tank (fragmented)
Figure 3A:
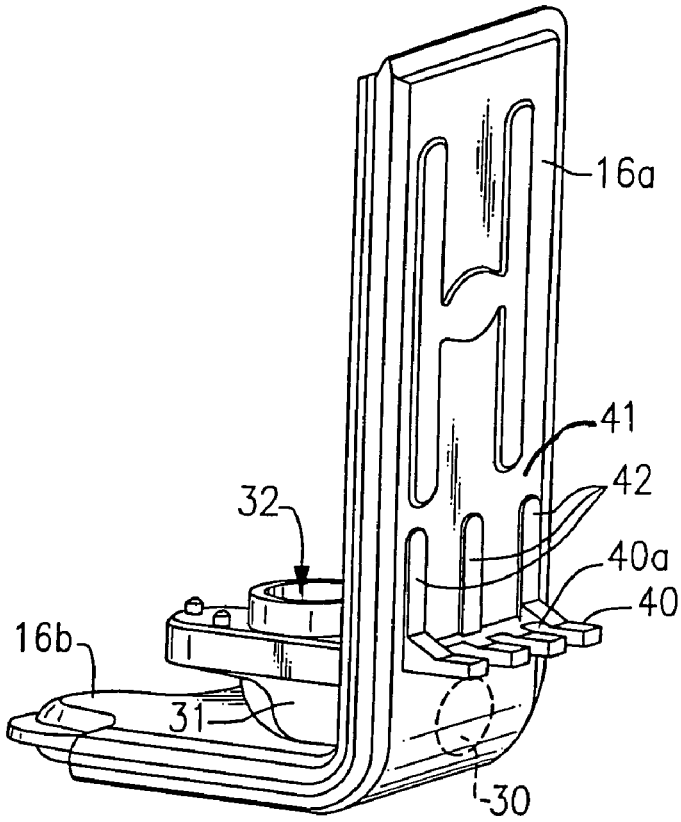
FIG. 3A is a perspective view of the fuel filter and pump connector showing the fuel filter in the substantially vertical position.

The shape and size of the opening 26 formed in the fuel tank bottom wall 10' and the shape and size of mounting platform 24 are cooperatively configured such that mounting platform 24 will act as a lid by closing and providing a leak-proof seal once attached thereto. It is also generally desirable from a design standpoint to keep the fuel module 12 as small as practical so as to maximize the allowable fuel volume in the tank. However, for filter element 16 to operate most effectively, at least part of the filter element 16 should lie along the bottom wall of the fuel tank so that it is always submerged in the fuel (assuming there is enough fuel in the tank to run the engine). In this operative position, filter element 16 extends in covering relation to the tank bottom wall 10', radially outwardly of the fuel pump 14 and the mounting platform 24. Since this position of the filter element 16 exceeds the size of the opening 26, the filter element 16 assumes an initial position that allows it to be easily passed through the opening 26. In the embodiment of FIGS. 1–3B, filter element 16 is initially positioned in a vertically extending manner as seen in FIGS. 2A and 3A. In this position, the filter elongated section 16*a* lies closely adjacent the side wall of the pump 14, parallel to the longitudinal axis X—X thereof as seen best in FIG. 2A. In this position, the pump 14 and filter element 16 are easily passed through opening 26 as seen in FIG. 2A.

Figure 3B:
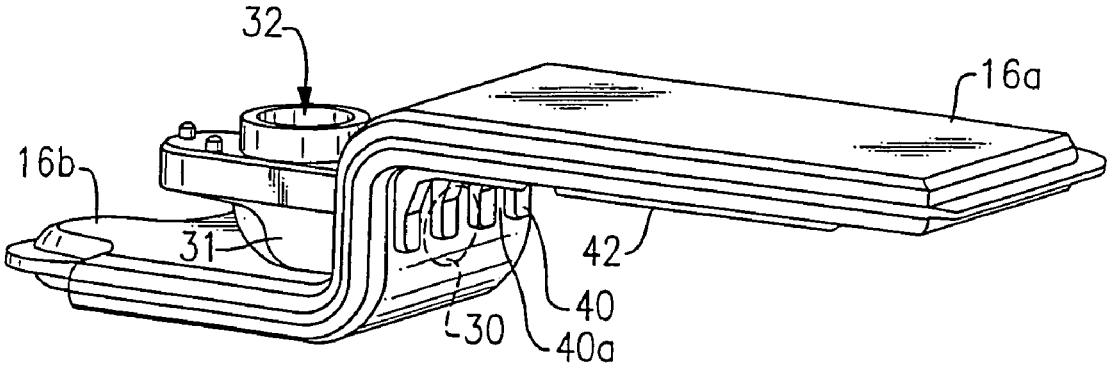
FIG. 3B is the view of FIG. 3A showing the fuel filter in the substantially horizontal position.

As the pump 14 and filter 16 are advanced further into opening 26 (in a direction substantially parallel to axis X—X), the edge of the tank opening 26 strikes a bearing surface 40 which is attached to and extends perpendicularly from an outer surface 41 of filter elongated section 16*a*. Further advancement of pump 14 and filter element 16 through opening 26 causes bearing surface 40 to pivot (and hence also the filter elongated section 16*a*) downwardly in a direction away from the pump as seen in FIG. 2B. Once the pump 14 and filter element 16 have been fully advanced through opening 26, bearing surface 40 has moved to a vertical position and filter elongated section 16*a* has moved to a subsequent resting position which, in this embodiment, is the preferential horizontal position as seen in FIGS. 1, 2C and 3B.

One or more reinforcing ribs 42 may be provided which extend substantially perpendicularly to bearing surface 40. The reinforcing ribs 42 are attached directly to the elongated section 16*a* and operate to assist in keeping the elongated section 16*a* straight and also add structural stability to the bearing surface 40. Also, bearing surface 40 may include one or more openings 40*a* for the passage of fuel therethrough. In the first embodiment shown in FIGS. 1–3B, bearing surface 40 is positioned adjacent connector 31 and covers inlet 30 when in the final position seen in FIGS. 1, 2C and 3B. As such, the provision of passages 40*a* allow for more fuel flow through this area of elongated section 16*a*.

If desired, fuel filter element 16 may include a base section 16*b* that is contiguous with elongated section 16*a*. Base section 16*b* may be positioned beneath connector 31 where it assumes a substantially horizontal position in the tank 10. Fuel may also wick through base section 16*b* which thereby traps large particulate in the fuel prior to the fuel reaching inlet 30 from this section of the filter element 16.

Figure 4:
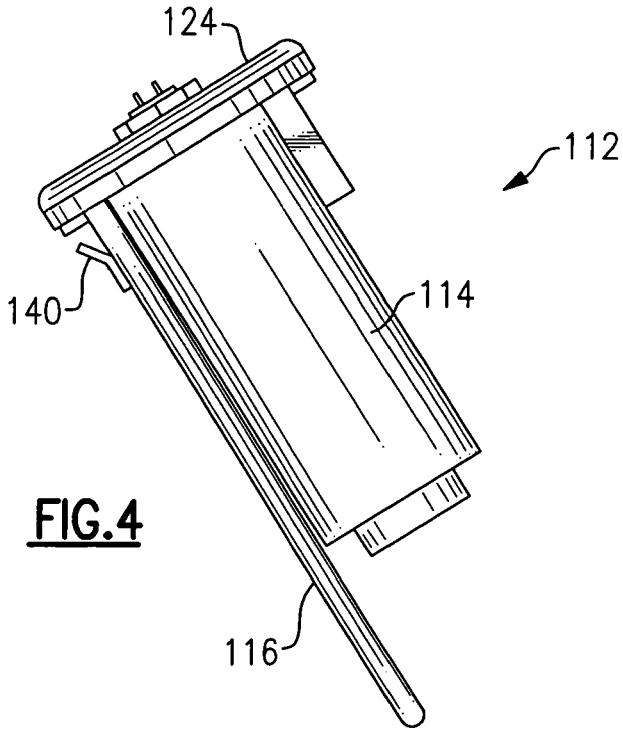
FIG. 4 is a side, elevational view of a second embodiment of the invention.
Figure 5:
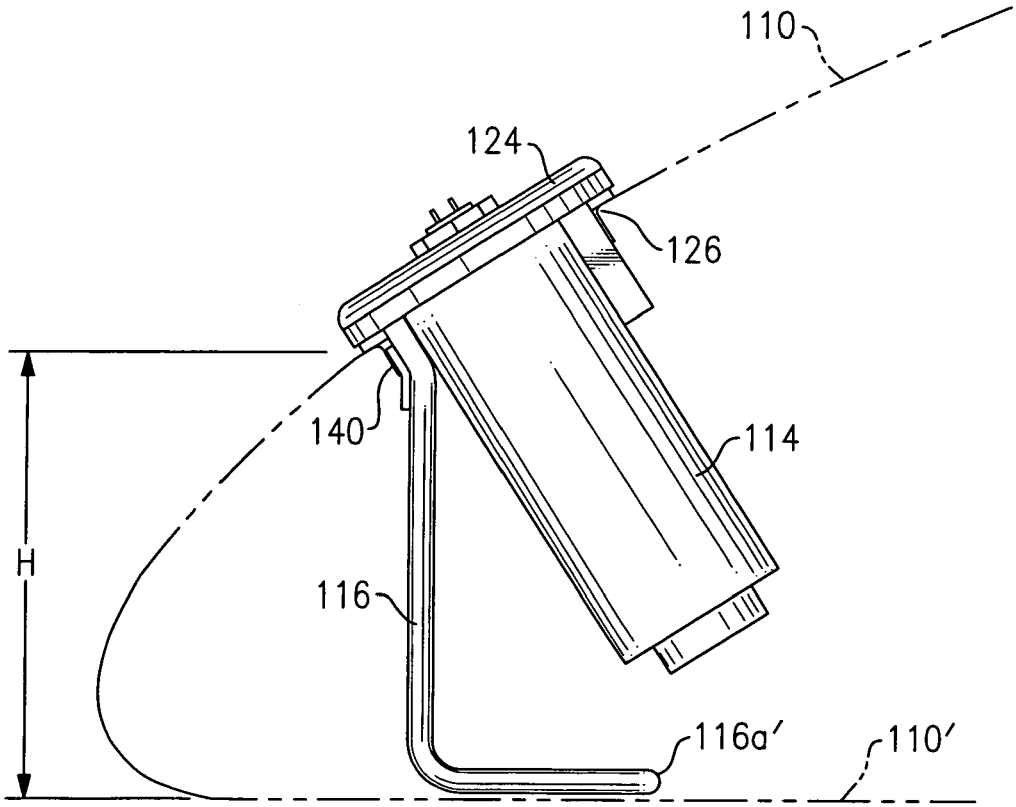
FIG. 5 is a side, elevational view of the embodiment of FIG. 4 mounted to a fuel tank shown in dashed lines.

In a second embodiment of the invention shown in FIGS. 4 and 5, the mounting platform 124 carrying the filter element 116 is inserted through a top opening 126 of the tank 110. In this embodiment, the bearing surface 140 is positioned adjacent the mounting platform 124 and filter element 116 is longer than the height "H" of the tank 110 at the point where it becomes located therein. Thus, as the fuel module 112 is inserted through opening 126, filter element free end 116'*a* hits the bottom wall of the tank 110' causing filter element 116 to bend into the "L" shape seen in FIG. 5. Near full advancement, bearing surface 140 strikes the perimeter of opening 126 causing the bearing surface and filter element 116 to pivot away from the fuel pump 114. As such, filter element 116 becomes preferentially positioned within tank 10.

It may thus be realized that the present invention provides a fuel filter element and method of inserting a self positioning filter element into a fuel tank which optimizes the size of the filter element without requiring enlargement of the opening in the tank while also preferentially positioning the filter element in the tank.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel delivery system comprising:

a) a fuel tank having an edge defining an opening;

b) a fuel filter having an elongated filtering section and a bearing surface extending from an outer surface of said elongated filtering section, said bearing surface positioned to strike said fuel tank edge as said filter is inserted into said tank through said opening, and thereby causing said elongated filtering section to move from an initial insertion position to a subsequent resting position once said filter is fully inserted into said fuel tank.

2. The fuel delivery system of claim 1, and further comprising a fuel pump to which said filter is attached whereby said fuel pump and said filter may be inserted together as a unit into said fuel tank.

3. The fuel delivery system of claim 2 wherein said fuel pump is mounted to a mounting platform, said mounting platform operable to close and seal said fuel tank opening once said pump and said filter are fully inserted into said tank.

4. The fuel delivery system of claim 3 and further comprising a second stage fuel filter mounted to said mounting platform and a fuel line extending between said fuel pump and said second stage fuel filter.

5. The fuel delivery system of claim 1 wherein said fuel tank is for a motorcycle.

6. A fuel filter for mounting inside a fuel tank, said fuel tank having an opening through which said filter may be passed, said filter having an elongated filtering section and a bearing surface, said bearing surface extending from an outer surface of said elongated filtering section, said bearing surface positioned to strike an edge of said opening as said filter is passed through said opening and into the tank, said bearing surface operable to cause said elongated filtering section to move from an initial insertion position to a subsequent resting position once said filter is fully inserted into said tank through said opening.

7. The fuel filter of claim 6 wherein said bearing surface extends substantially perpendicular to said elongated filtering section.

8. The fuel filter of claim 7 and further comprising at least one rib attached to said bearing surface and said elongated filtering section.

9. The fuel filter of claim 8 and further comprising a mounting platform upon which said filter is mounted prior to being inserted into said tank, said mounting platform configured to close and seal said opening once said filter has been fully inserted into said opening.

10. The fuel filter of claim 9 and further comprising a fuel pump mounted to said mounting platform, said filter being attached to said pump such that fuel in said tank is passed through said filter prior to entering said pump.

11. The fuel filter of claim 10 and further comprising a second stage fuel filter mounted to said mounting platform and a fuel line extending between said fuel pump and said second stage fuel filter.

12. The fuel filter of claim 6 wherein said fuel tank is for a motorcycle.

13. The fuel filter of claim 6 wherein said bearing surface includes at least one opening for the passage of fuel therethrough.

14. The fuel filter of claim 6 wherein said fuel filter further includes a base section extending in a contiguous manner from said elongated filtering section, said base section lying substantially horizontal when said filter is fully inserted into said tank.

15. A method of inserting a fuel filter having an elongated section into a fuel tank through an opening in the fuel tank, said method comprising the steps of:

a) providing a bearing surface on said filter elongated section in substantially perpendicular relation thereto;

b) passing said elongated section through said opening with said elongated section lying in an initial insertion position; and c) continuing advancement of said filter through said opening whereupon said bearing surface strikes the edge of said opening causing said elongated section to move to a subsequent resting position.

16. The method of claim 15 and further comprising the step of attaching said filter to a fuel pump and passing said filter and pump together as a unit through said opening.

17. The method of claim 16 and further comprising the step of mounting said pump and filter on a mounting platform prior to passing said pump and filter through said opening, said mounting platform configured for closing and sealing said opening upon full insertion of said pump and filter into said fuel tank.

18. The method of claim 17 and further comprising the step of mounting a second stage fuel filter to said mounting platform.

19. The method of claim 17 wherein said bearing surface is positioned on said filter elongated section adjacent to said mounting platform.

20. The method of claim 15 and further comprising the step of providing at least one opening in said bearing surface for the passage of fuel therethrough.

21. The method of claim 15 wherein said fuel filter further includes a base section which lies in a substantially horizontal position upon full insertion of said pump and filter into said fuel tank.

* * * * *